US007315719B2

(12) United States Patent
Wagner et al.

(10) Patent No.: US 7,315,719 B2
(45) Date of Patent: Jan. 1, 2008

(54) TRANSFER CHARGE DEVICE COVER IN NON-IMAGE RECEIVING MEDIUM AREA

(75) Inventors: Mortiz P. Wagner, Walworth, NY (US); Michael Turan, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 112 days.

(21) Appl. No.: 11/139,545

(22) Filed: May 31, 2005

(65) Prior Publication Data

US 2006/0269324 A1 Nov. 30, 2006

(51) Int. Cl.
*G03G 15/16* (2006.01)

(52) U.S. Cl. ..... 399/297; 399/310; 399/311

(58) Field of Classification Search ..... 399/169, 399/100, 101, 311
See application file for complete search history.

(56) References Cited

U.S. PATENT DOCUMENTS 3,388,644 A * 6/1968 Granzow et al. ..... 399/169
3,850,519 A * 11/1974 Weikel, Jr. ..... 399/316
4,370,048 A * 1/1983 Shibuya et al. ..... 399/398
4,469,428 A * 9/1984 Yoshioka et al. ..... 399/169
4,603,964 A * 8/1986 Swistak ..... 399/169
5,499,086 A * 3/1996 Matsuno et al. ..... 399/313
5,585,908 A 12/1996 Rakov et al.
5,646,717 A * 7/1997 Hiroshima et al. ..... 399/154

* cited by examiner

*Primary Examiner*—David M. Gray
*Assistant Examiner*—David A Blackshire
(74) *Attorney, Agent, or Firm*—Oliff & Berridge, PLC

(57) ABSTRACT

An image forming apparatus may include: a photoreceptor and a corona charging device or bias transfer roller that provides a charge to an image receiving medium. A cover may be disposed over a portion of the corona charging device or the bias transfer roller to shield the photoreceptor from exposure to the charge from the corona charging device when image receiving medium is charged and in contact with the photoreceptor.

8 Claims, 4 Drawing Sheets

FIG. 2
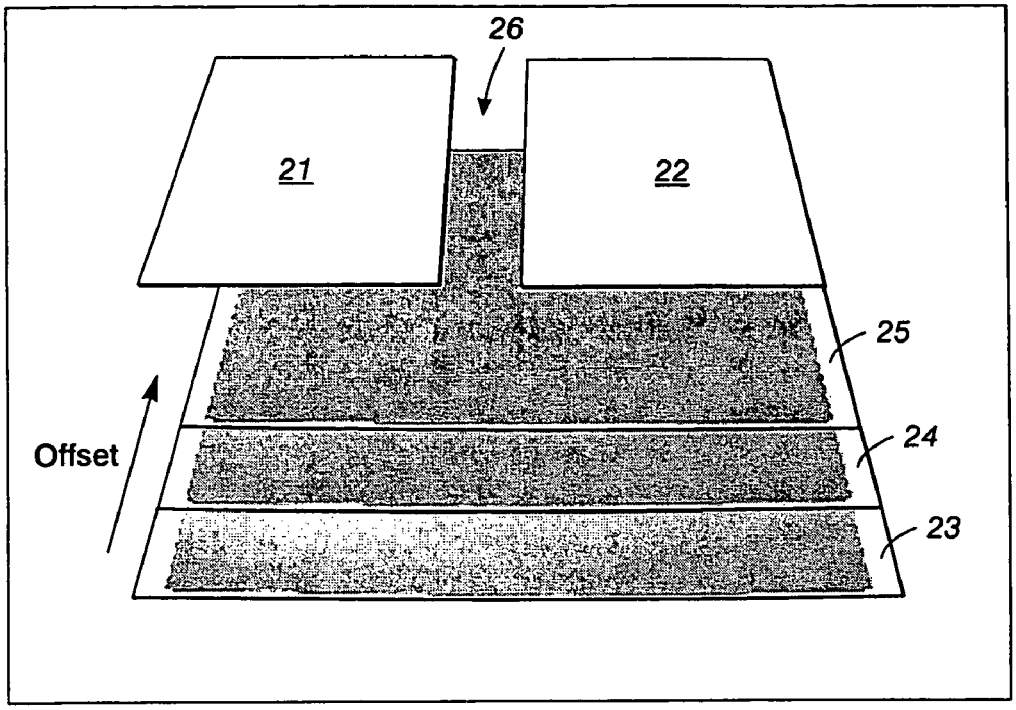
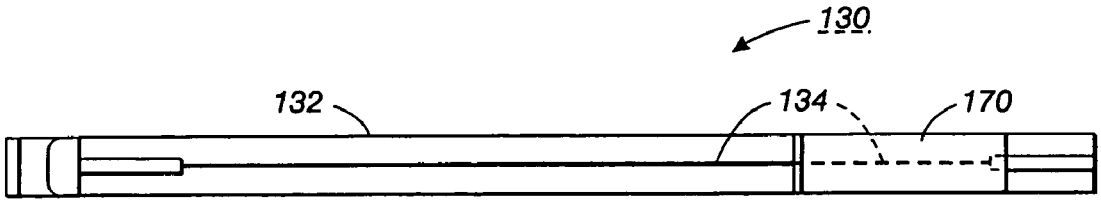
FIG. 3
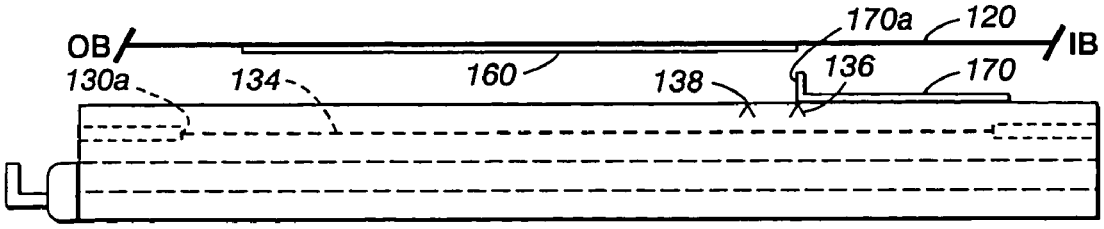
FIG. 4

FIG. 5
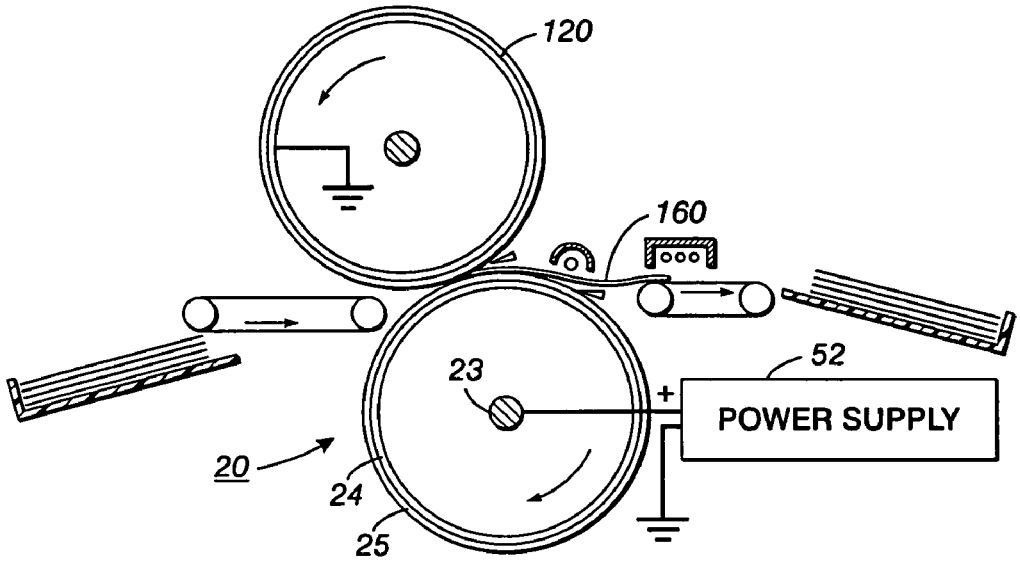
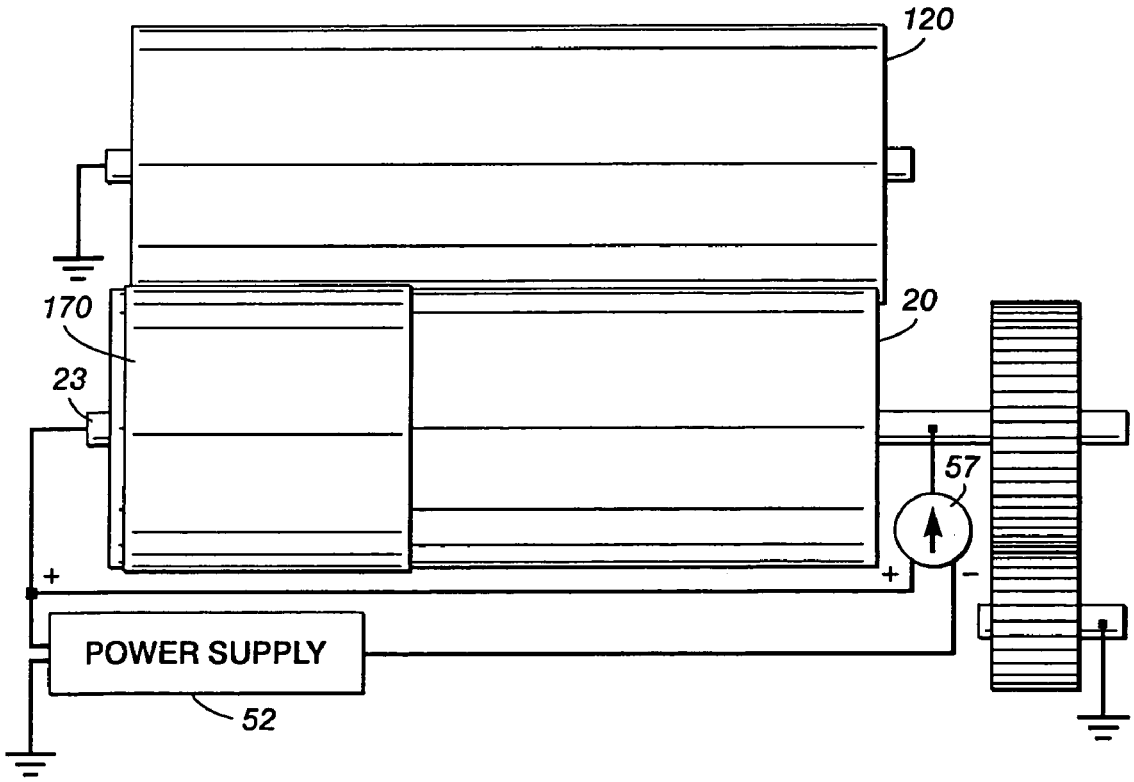
FIG. 6

FIG. 7
| Image Receiving Medium | Recommended Transfer Current with Standard Corona Charging Device | Transfer Current With Cover at 12-inch | Transfer Current With Cover at 11-inch |
|---|---|---|---|
| Standard | 120 μA | 95 μA | 85 μA |
| Coated/ Heavy Weight | 150 μA | 120 μA | 110 μA |
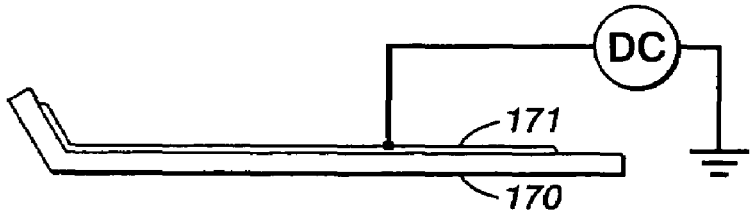
FIG. 8
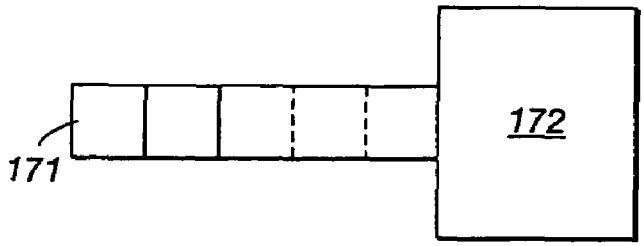
FIG. 9

TRANSFER CHARGE DEVICE COVER IN NON-IMAGE RECEIVING MEDIUM AREA

BACKGROUND

Exemplary aspects of this disclosure relate to systems and apparatus for preventing paper edge ghost in an electrophotographic or xerographic system.

The xerographic imaging process is initiated by charging a charge retentive surface, such as that of a photoconductive member, to a uniform potential. The charge retentive surface is then exposed to a light image of an original document, either directly or via a digital image driven laser. Exposing the charged photoconductor to light selectively discharges areas of the charge retentive surface while allowing other areas to remain unchanged. This creates an electrostatic latent image of the document on the surface of the photoconductive member.

Developer material is then brought into contact with the surface of the photoconductor material to develop the latent image into a visible reproduction. The developer typically includes toner particles with an electrical polarity that is the same as, or that is opposite to, the polarity of the charges remaining on the photoconductive member. The polarity depends on the image profile.

A blank image receiving medium is then brought into contact with the photoreceptor and the toner particles are transferred to the image receiving medium. The toner particles forming the image on the image receiving medium are subsequently heated, thereby permanently fixing the reproduced image to the image receiving medium.

Electrophotographic or xerographic laser printers, scanners, facsimile machines and similar document reproduction devices must be able to maintain proper control over the systems of the image forming apparatus to assure high quality output images.

FIG. 1 shows an exemplary embodiment of an image forming apparatus 100 having a photoreceptor 120. The image forming apparatus 100 may be a xerographic printer or other known or later developed xerographic device.

As shown in FIG. 1, one or more latent images may be generated on the photoreceptor 120, in any well known manner, by controlling one or more of a number of different developer units 150 using controller 110.

In many xerographic machines, where high image quality targets are desired, the photoreceptor is first charged. For example, as shown in FIG. 1, in the direction of movement of the photoreceptor 120, as indicated by the arrows, the photoreceptor 120 is charged to lay a first level of toner onto the photoreceptor. Next, the charge laid is exposed by exposing unit 140. Finally, the toner is developed by developing unit 150. The process continues in the direction of movement of the photoreceptor 120 until all layers of toner are laid, for example, to complete an image-on-image full-color image forming process. Once the full-color image is finished, the completed image is transferred to a sheet of image receiving medium 160. In the transfer process, the sheet of image receiving medium 160 is charged by a corona charge device or a bias transfer roller. The layers of toner are transferred to the sheet of image receiving medium 160 by the application of an electrostatic field of a direction urging the toner to move from the photoreceptor 120 to the sheet of image receiving medium 160. Specifically, ions are placed onto the backside of the sheet of image receiving medium by the corona charging device or the bias transfer roller.

The charging procedure of a charging device is performed to produce a very uniform charge on the photoreceptor. This uniform charge is especially important in the image-on-image type xerographic color machines, as shown in FIG. 1, where the photoreceptor may be covered by multiple layers of toner.

SUMMARY

Exemplary aspects of this disclosure provide systems and apparatus for reducing and/or eliminating paper edge ghosting.

Exemplary aspects of this disclosure provide a cover for a corona charging device to reduce or prevent charge exposure of the portions of the photoreceptor not covered by the image receiving medium during the transfer process.

Exemplary aspects of this disclosure provide a cover for a bias transfer roller to reduce or prevent charge exposure of the portions of the photoreceptor not covered by the image receiving medium during the transfer process.

Exemplary aspects of this disclosure provide at least one cover, for a corona charging device or a bias transfer roller, that is sized according to a size of image receiving medium.

Exemplary aspects of this disclosure provide at least one cover, for a corona charging device or a bias transfer roller, including a shutter to prevent charge exposure of portions of the photoreceptor not covered by the image receiving medium during the transfer process.

Exemplary aspects of this disclosure provide a constant current to the corona charging device or the bias transfer roller that varies depending on image receiving medium width to maintain proper charge density.

Exemplary aspects of this disclosure provide a cover including a conductive surface, which may be voltage biased to reduce or prevent toner buildup on the cover.

In many cases, the image receiving medium 160 is not as wide as the photoreceptor 120 causing portions of the photoreceptor 120 to be exposed to charge of the charging device. This creates trapped charges in the exposed portions of the photoreceptor 120, which after multiple transfer cycles leads to a permanent defect in the portions of the photoreceptor 120 not covered by the image receiving medium. This defect, referred to as paper edge ghost, typically may be seen as a darkened halftone due to the increased development field from the trapped charges in the photoreceptor 120. Paper edge ghost will typically be observed in an inboard image receiving medium area when switching from one image receiving medium size to another. FIG. 2 shows examples of paper edge ghost.

FIG. 2 depicts two sheets of image receiving medium 21, 22 that were continually run through an image forming apparatus. The two sheets 21, 22 were spaced apart from each other to create space 26 and allow the photoreceptor to be exposed to the corona charging device through the space 26. After one thousand exposures, a sheet of image receiving medium 23 having a size equal to image receiving medium 21 and 22 combined and including the space 26 was run through the image forming apparatus. The portion of the image receiving medium 23 corresponding to space 26 shows paper edge ghost resulting from one thousand exposures. Image receiving medium 24 and 25 have sizes that correspond to image receiving medium 23. The portions of image receiving medium 24 and 25 corresponding to space 26 show paper edge ghost resulting from three thousand exposures and six thousand exposures respectively.

BRIEF DESCRIPTION OF THE DRAWINGS

Various exemplary embodiments of this disclosure will be described in detail with respect to the following drawings, in which like reference numerals indicate like elements, and wherein:

FIG. 2 is a schematic of paper edge ghost occurring on image receiving medium;

FIG. 3 is a schematic of a corona charging device including a cover according to an exemplary embodiment;

FIG. 4 is a schematic of a corona charging device including a cover according to another exemplary embodiment;

FIGS. 5 and 6 are schematics of a bias transfer roller including a cover according to another exemplary embodiment;

FIG. 7 is a table showing current provided to a corona charging device including a cover according to an exemplary embodiment, the current being varied depending on a width of the image receiving medium;

FIG. 8 is a schematic of a cover including a conductive surface according to an exemplary embodiment; and FIG. 9 is a schematic of a corona charging device including a shutter according to an exemplary embodiment.

DETAILED DESCRIPTION OF EXEMPLARY EMBODIMENTS

Figure 1:
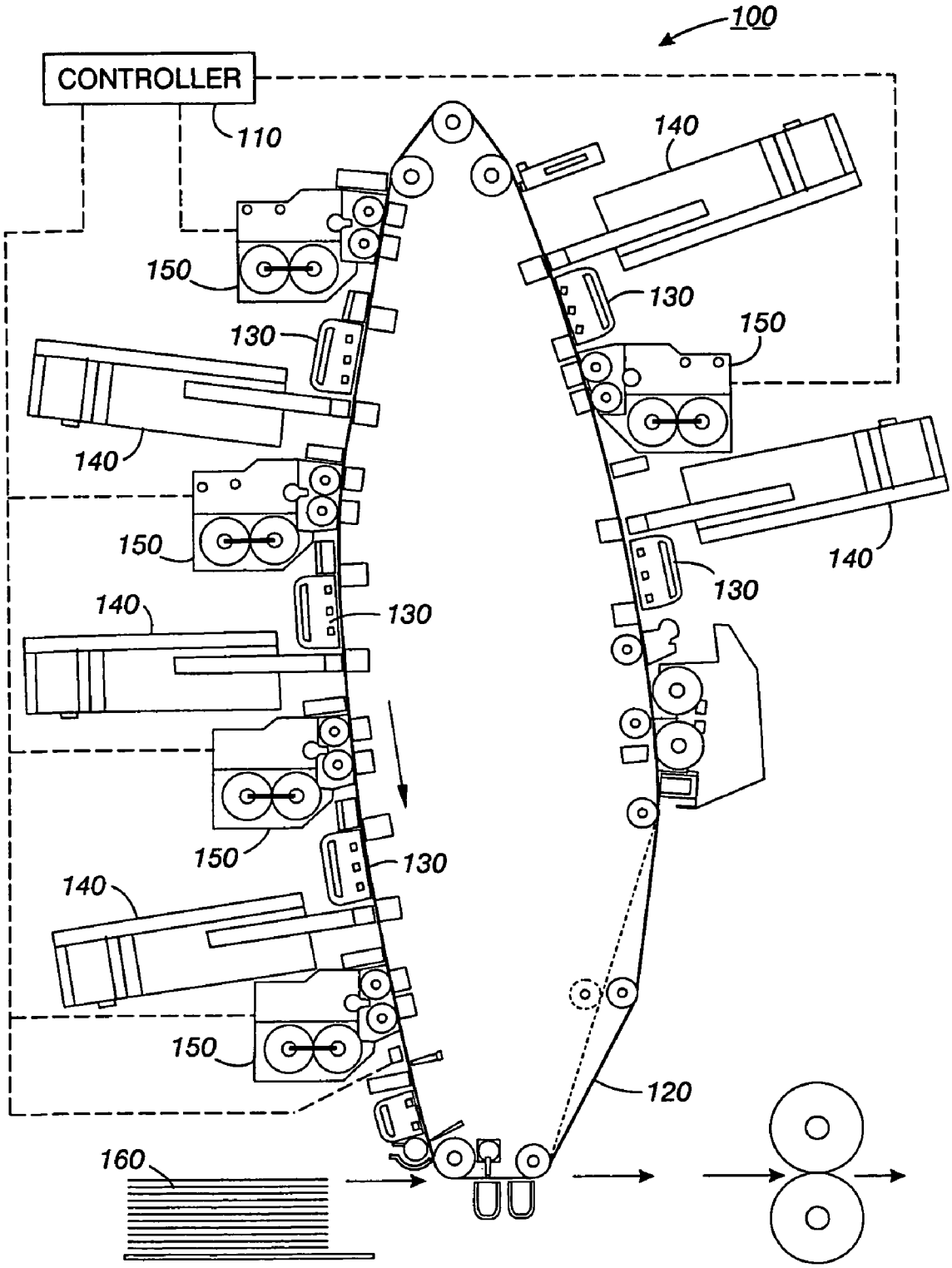
FIG. 1 is a schematic of a related art image forming apparatus.

FIG. 3 is a schematic of an exemplary corona charging device 130 including a shield 132 typically formed of aluminum or the like and having an open lower end, a corona discharge electrode 134, such as a glass coated tungsten wire or the like and extending within the shield 132. A charge leveling grid is provided opposite the opening of the shield. A high voltage AC source is connected to the corona discharge electrode 134 to produce the corona discharge.

FIG. 4 depicts a corona charging device 130. Corona charging devices emit a corona from emission portion 130*a* in a predetermined direction. Cover 170 is placed over the corona charging device 130 to intercept the corona emissions. Cover 170 is placed over the corona charging device so that a tip 170*a* of the cover is aligned with an inscribed mark 136 or 138. The inscribed marks 136 and 138 delineate the widths of commonly sized image receiving medium 160, for example 11", 12" that are being used in the image forming apparatus 100.

FIGS. 5 and 6 are schematics of a transfer bias roller 20 used in conjunction with cover 170. The cover 170 must match the circular configuration of and lay flat on, the transfer bias member 20.

The bias transfer roller 20 is driven by a shaft 23 and has an inner layer 24 formed of any suitable conductive material. The outer layer 25 may be formed from any suitable non-conductive material. An electric potential is placed on the inner layer via the shaft 23 connected to a constant current source 57 and power supply 52. A sheet of image receiving medium 160 passes through a nip formed between the photoreceptor 120 and the bias transfer roller 20. A transfer field is generated in the nip and the toner particles are transferred to the image receiving medium 160.

The cover 170 shields that portion of emission portion 130*a* of the corona charging device 130 that extends beyond the width of the image receiving medium 160. By shielding that portion of emission portion 130*a* of corona charging device 140 that extends beyond the width of the image receiving medium 160, the corona emissions are intercepted. The photoreceptor 120 is not exposed to the corona emissions and no charges become trapped in the photoreceptor 120. Thus, during subsequent uses of the image forming apparatus 100 paper edge ghost is reduced or prevented.

FIG. 4 depicts the position of the image receiving medium 160 during charging by the corona charging device 130. The photoreceptor 120 has an inbound portion IB and an outbound portion OB. The inbound portion IB of the photoreceptor 120 is protected from the emission of the corona charging device 130 by the cover 170. Thus, the photoreceptor 120 is not exposed to charges that may become trapped. Paper edge ghost is reduced or prevented when switching to an image receiving medium 160 of a different size that comes in contact with the protected portion of the photoreceptor 120.

The cover 170 may be replaced manually prior to use of image receiving medium 160 having various sizes. Multiple covers 170 may be provided which correspond to commonly used image receiving medium 160 of varying sizes. Alternatively, a single cover 170 having an adjustable width may be provided.

In another exemplary embodiment, an image forming apparatus may include a cover 170 in the form of a shutter 171, shown in FIG. 9, having a variable dimension which changes in accordance with a detected size of the image receiving medium 160. Thus, if an image receiving medium 160 having a width of 11" is detected, the shutter 171 expands or contracts to cover the corona charging device 130 or bias transfer roller 20 so that the portion of the photoreceptor 120, not covered by the image receiving medium 160, is not exposed. The shutter 171 may be manually operated or have its expansion and contraction controlled by a motor 172. The motor 172 may be connected to a control unit that controls expansion or contraction based on the detected size of the image receiving medium 160 or as a result of signals received from a sensor that detects the edge of the image receiving medium 160.

The corona charging device 130 is a constant current device. The power supply is programmed to provide a constant current. Without the cover 170, the transfer current goes partially down in the area of the photoreceptor 120 not covered by the image receiving medium. The "lost" current causes the paper edge ghost. The lost current, which is a function of the thickness of the image receiving media, is difficult to control. When the cover 170 is placed over the corona charging device 130, the transfer current goes to the image receiving medium 160 only, and may be controlled more precisely because there is no lost current.

For each image receiving medium 160 it is preferable to keep the charge density, the charge per unit width of image receiving medium 160, constant, independent of the width of the image receiving medium. Because there are no losses to the photoreceptor 120 with the cover 170 and the transfer power supply is a constant current supply, the current may be adjusted accordingly to the width of the image receiving medium 160 to maintain an ideal charge density.

FIG. 7 is a table showing the recommended transfer current with a standard corona charging device 130 without cover 170, using two types of paper as the image receiving medium. With standard paper, the recommended transfer current is 120 μA. With coated/heavy weight paper, the recommended transfer current is 150 μA. When using paper having a width of twelve inches and cover 170 with a corresponding length placed, over the corona charging device 130, the current may be adjusted to 95 μA for standard paper and 120 μA for coated/heavy weight paper to maintain ideal charge density. When using a paper having a width of eleven inches and cover 170 with a corresponding length placed over the corona charging device 130, the current may be adjusted to 85 μA for standard paper and 110 μA for coated/heavy weight paper.

Accordingly, depending on the type and width of the image receiving medium 160, the current should be adjusted to maintain the ideal charge density. Ideal charge density is dependent on the type of image receiving medium and may vary based on, for example, thickness and type of material.

In use, toner may build up on the cover 170. Thus, in an exemplary embodiment, the cover may be provided with a conductive surface 171, such as copper or the like. The conductive surface is biased, for example with −300V. This may reduce or prevent the buildup of toner on the cover 170.

The cover 170 may be placed as close as possible to the photoreceptor 120 to reduce or prevent leakage of current from the corona charge device 130 or the transfer bias roller to the photoreceptor at the edges. It is also useful to overlap the cover 170 with the inbound edge of the image receiving medium 160 to reduce or prevent leakage of current. Typically, the closer the cover 170 is placed to the photoreceptor 120, the less overlap that may be required between the cover 170 and the inbound edge of the image receiving medium 160.

The above embodiments relate to providing at least one cover and adjusting current based on the width of the paper receiving medium. It should be appreciated by one having ordinary skill in the art, the cover may relate to the image receiving medium in any suitable manner, such as length, so that the portion of the corona charging device or bias transfer roller not covered by the image receiving medium is shielded from charging.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. An image forming apparatus, comprising:

a photoreceptor;

a corona charging device that provides a charge to an image receiving medium; and a cover, disposed over a portion of the corona charging device, that shields the photoreceptor from exposure to the charge from the corona charging device when the corona charging device charges the image receiving medium in contact with the photoreceptor, wherein the cover includes a conductive surface;

wherein the cover comprises a shutter.

2. The image forming device according to claim 1, wherein a size of the cover corresponds to a size of the image receiving medium.

3. The image forming apparatus according to claim 1, further comprising:

a current source to provide a constant current to the corona charging device; and a controller to adjust the constant current based on the image receiving medium size to maintain an ideal charge density.

4. An image forming apparatus, comprising:

a photoreceptor;

a transfer bias roller that provides a charge to an image receiving medium; and a cover, disposed over a portion of the bias transfer roller, that shields the photoreceptor from exposure to the charge from the bias transfer roller when the bias transfer roller charges the image receiving medium in contact with the photoreceptor, wherein the cover includes a conductive surface;

wherein the cover comprises a shutter.

5. The image forming apparatus according to claim 4 wherein a size of the cover corresponds to a size of the image receiving medium.

6. The image forming apparatus according to claim 4, further comprising:

a current source to provide a constant current to the bias transfer roller; and a controller to adjust the constant current based on the paper width, to maintain an ideal charge density.

7. A method of preventing paper edge ghost, in an image forming apparatus, including a photoreceptor and a transfer charging device, comprising:

shielding a portion of the photoreceptor from the transfer charging device, the portion of the photoreceptor corresponding to a surface of the photoreceptor not covered by a sheet of image receiving medium during an image transfer process, the transfer charging device being a corona charging device and a cover being placed over a portion of the corona charging device that corresponds to the surface of the photoreceptor not covered by the sheet of image receiving medium;

providing a conductive surface over the cover; and biasing the conductive surface;

wherein the cover comprises a shutter.

8. The method of claim 7, further comprising:

providing a constant current source to the transfer charging device; and controlling the constant current to maintain an ideal charge density.

* * * * *